US009354566B2

(12) United States Patent
Kirikubo et al.

(10) Patent No.: US 9,354,566 B2
(45) Date of Patent: May 31, 2016

(54) IMAGE FORMING APPARATUS WITH SWITCHABLE DEMAGNETIZING COIL AND CONTROL METHOD

(71) Applicant: KONICA MINOLTA, INC., Chiyoda-ku (JP)

(72) Inventors: Seiichi Kirikubo, Toyohashi (JP); Masahiro Kamiya, Toyohashi (JP); Takahiro Tsujimoto, Toyokawa (JP); Yutaka Yamamoto, Shinshiro (JP); Hidenori Mine, Toyohashi (JP); Nobuhiro Matsuo, Toyokawa (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 67 days.

(21) Appl. No.: 14/178,342

(22) Filed: Feb. 12, 2014

(65) Prior Publication Data

US 2014/0233976 A1 Aug. 21, 2014

(30) Foreign Application Priority Data

Feb. 18, 2013 (JP) ..... 2013-029028

(51) Int. Cl.
*G03G 15/20* (2006.01)

(52) U.S. Cl.
CPC ..... *G03G 15/2042* (2013.01)

(58) Field of Classification Search
None
See application file for complete search history.

(56) References Cited

U.S. PATENT DOCUMENTS 6,246,843 B1 * 6/2001 Nanataki et al. ..... 399/45
6,346,800 B1 2/2002 Mano et al.
2007/0201913 A1 8/2007 Kamoda (Continued)

FOREIGN PATENT DOCUMENTS

CN 101030066 A 9/2007
CN 102467044 A 5/2012

(Continued)

OTHER PUBLICATIONS

Office Action (Notification of Reasons for Refusal) issued on Feb. 17, 2015, by the Japanese Patent Office in corresponding Japanese Patent Application No. 2013-029028 and an English translation of the Office Action. (5 pages).
Office Action (First Office Action) issued on Aug. 14, 2015, by the Chinese Patent Office in corresponding Chinese Patent Application No. 201410053041.7, and an English Translation of the Office Action. (12 pages).

*Primary Examiner* — David Gray
*Assistant Examiner* — Geoffrey Evans
(74) *Attorney, Agent, or Firm* — Buchanan Ingersoll & Rooney PC

(57) ABSTRACT

An image forming apparatus having: a power source applying alternating current voltage to the magnetizing coil; a demagnetizing coil switchable between a conductive state and a cutoff state, and when in the conductive state, cancelling out a portion of a magnetic flux produced by the magnetizing coil; a contact switch and a semiconductor switch electrically connected in parallel, and, in combination, bringing the demagnetizing coil into the conductive state or the cutoff state; and a control unit opening or closing the switches separately. The control unit: opens or closes the semiconductor switch in synchronization with a zero-crossing of the alternating current voltage at least when the contact switch is open; opens or closes the contact switch only when the semiconductor switch is closed; and opens the semiconductor switch when the demagnetizing coil brought into the conductive state by the contact switch needs to be maintained in the conductive state.

7 Claims, 18 Drawing Sheets

(56) References Cited

U.S. PATENT DOCUMENTS

| | | | | |
|---|---|---|---|---|
| 2009/0148205 | A1 | 6/2009 | Seo et al. | |
| 2012/0107028 | A1 | 5/2012 | Mizumo | |
| 2013/0071134 | A1* | 3/2013 | Hikari | G03G 15/80 399/88 |

FOREIGN PATENT DOCUMENTS

| | | | |
|---|---|---|---|
| JP | 2000-321894 | A | 11/2000 |
| JP | 2002-182526 | A | 6/2002 |
| JP | 2009-145421 | A | 7/2009 |
| JP | 2011-197447 | A | 10/2011 |

* cited by examiner

IMAGE FORMING APPARATUS WITH SWITCHABLE DEMAGNETIZING COIL AND CONTROL METHOD

CROSS-REFERENCE TO RELATED APPLICATION

This application is based on application No. 2013-029028 filed in Japan, the contents of which are hereby incorporated by reference.

BACKGROUND OF THE INVENTION (1) Field of the Invention

The present invention relates to an image forming apparatus and a control method, and particularly to technology of extending the lifespan of switches for turning on and off a demagnetizing coil provided in a fixing device that utilizes electromagnetic induction heating.

(2) Related Art

In recent years, fixing devices utilizing electromagnetic induction heating have been commonly adopted in electrophotographic image forming apparatuses in order to shorten the warm-up period. In fixing by electromagnetic induction heating, a fixing roller for heating and fusing toner images is heated by a magnetizing coil using induction.

When the entire length of the fixing roller in the direction of its rotation shaft is heated by the magnetizing coil using induction, if small sheets having a width smaller than the length of the fixing roller are continuously conveyed, the non-sheet passing region, where recording sheets do not pass through, is continuously heated without being cooled by the recording sheets. Consequently, the temperature of the non-sheet passing region increases. Such overheating of the non-sheet passing region leads to deterioration and damage to the fixing roller or peripheral devices, which would be a cause of a short lifespan.

A common countermeasure to the overheating of the non-sheet passing region is to use demagnetizing coils to prevent magnetic coupling of the magnetic flux, produced by the magnetizing coil, with the fixing roller. The demagnetizing coils are turned on or off according whether the non-sheet passing region is overheated or not.

In the case where a contact switch is used for turning on or off the demagnetizing coils (cf. FIG. 15), if the contact switch 1502 is turned on while the magnetizing coil 1501 is generating an alternating magnetic flux, a high voltage is applied across the contact points, and arc discharge occurs (cf. FIG. 16). Similarly, if the contact switch 1502 is turned off under such a condition, arc electrostatic discharge occurs due to the back electromotive force (cf. FIG. 17). This phenomenon causes a problem that the contact points are greatly deteriorated and fused.

Considering this problem, when a contact switch is used for turning on and off demagnetizing coils, it is necessary to temporarily stop the output of the magnetizing coil before turning on or off the contact switch, and then resume the output of the magnetizing coil. Since contact switches require a certain amount of time to complete the operation (i.e. to be completely closed or opened) after being turned on or off, it is necessary to stop the alternating current (AC) voltage provided to the magnetizing coil for at least a half period of the voltage. If the operation for fixing is continued during this period, the sheet passing region, where the recording sheets pass through, of the fixing roller decreases in temperature, and it will be impossible to maintain the image quality.

In particular, when the paper conveyance speed is high, the non-sheet passing region is likely to be overheated. Frequent switching operations of the contact switch increase the period for which the output of the magnetizing coil stops, and accordingly the decrease in temperature becomes prominent. However, if the paper conveyance speed is decreased to maintain the image quality, the efficiency in processing small sheets will be degraded.

On the other hand, a semiconductor switch (cf. FIG. 18) needs a shorter period than a contact switch to turn on or off the demagnetizing coils. Specifically, a semiconductor switch can complete the operation for turning on or off the demagnetizing coils within a short period (no longer than 1 μs) in synchronization with a zero-crossing of the alternative power provided to the magnetizing coil 1801. Therefore, the use of a semiconductor switch prevents the electrical breakdown of the switch that would be caused by high voltage. Therefore, the demagnetizing coils 1805 can be turned on or off without stopping the output from the magnetizing coil 1801, and the above-described problem caused by stopping the output from the magnetizing coil 1801 can be solved.

However, semiconductor switches have a greater on-resistance than contact switches, and therefore exhibit great loss in their conductive state, which degrades the demagnetizing efficiency. To complement the degradation of the demagnetizing efficiency, it is possible to increase the number of the turns of the demagnetizing coils. Such alteration, however, leads to the increase in size, material cost, and manufacturing cost of the demagnetizing coils. Furthermore, semiconductor switches have another problem that the loss leads to generation of heat that would deteriorate or thermally damage the semiconductor switches, and semiconductor switches are therefore unlikely to withstand for a long use.

SUMMARY OF THE INVENTION

The present invention is made in view of the problems described above, and aims to provide an image forming apparatus utilizing electromagnetic induction heating, capable of turning on and off a demagnetizing coil without degrading the processing efficiency, and having an extended lifespan. The present invention also provides a control method for the same.

To fulfill the aim, one aspect of the present invention provides an image forming apparatus for fusing toner by using a fixing roller heated by electromagnetic induction caused by a magnetizing coil, and fixing a toner image on a recording sheet, the image forming apparatus comprising: a power source applying alternating current voltage to the magnetizing coil; a demagnetizing coil switchable between a conductive state and a cutoff state, and when in the conductive state, cancelling out a portion of a magnetic flux produced by the magnetizing coil; a contact switch and a semiconductor switch electrically connected in parallel, and, in combination, bringing the demagnetizing coil into the conductive state or the cutoff state; and a control unit opening or closing each of the contact switch and the semiconductor switch, wherein the control unit opens or closes the semiconductor switch in synchronization with a zero-crossing of the alternating current voltage at least when the contact switch is open, opens or closes the contact switch only when the semiconductor switch is closed, and opens the semiconductor switch when the demagnetizing coil brought into the conductive state by the contact switch needs to be maintained in the conductive state.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings.

DESCRIPTION OF PREFERRED EMBODIMENTS

The following describes an embodiment of an image forming apparatus and control method pertaining to the present invention, with reference to the drawings.

[1] Structure Of Image Forming Apparatus

First of all, the structure of the image forming apparatus pertaining to the present embodiment is described.

Figure 1:
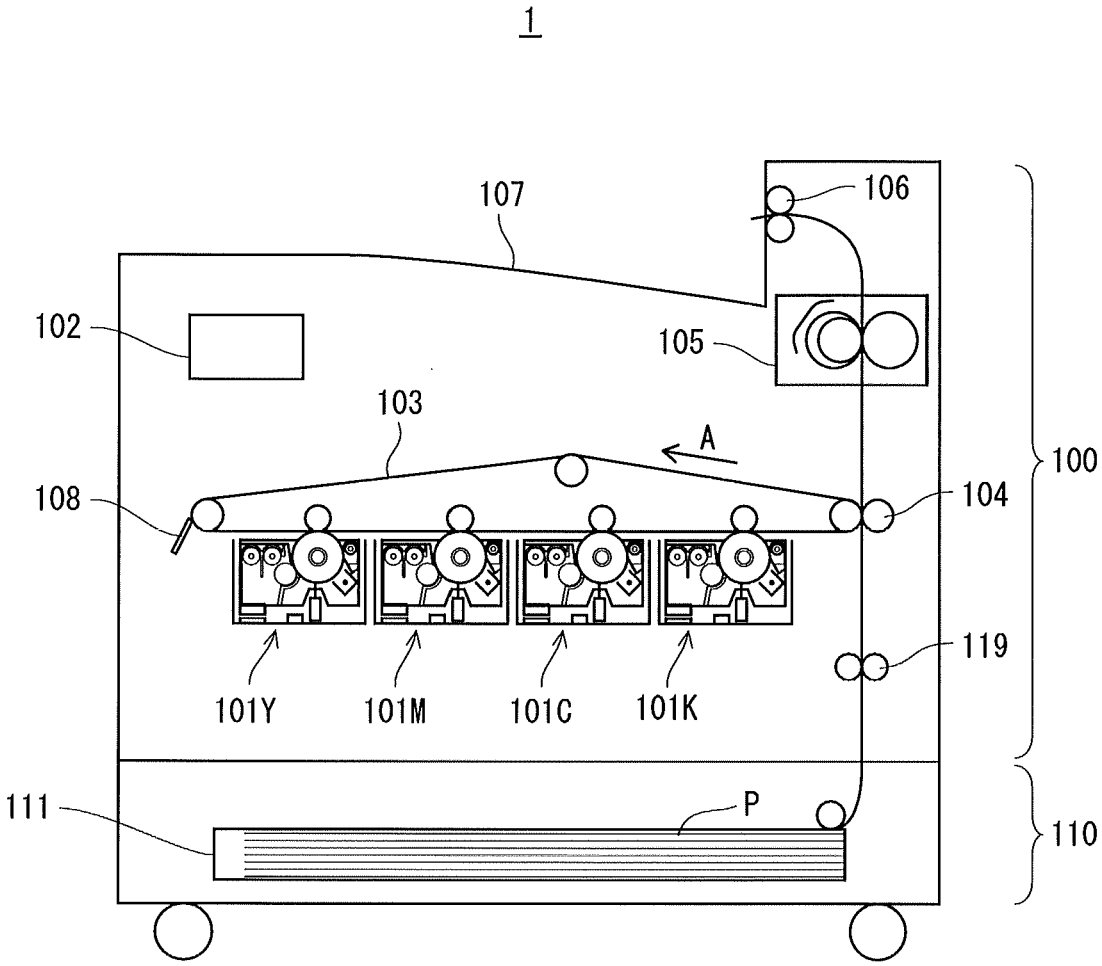
FIG. 1 shows primary components of an image forming apparatus pertaining to an embodiment of the present invention.

FIG. 1 shows primary components of an image forming apparatus pertaining to the present embodiment. As shown in FIG. 1, an image forming apparatus 1 is a tandem color printer, and includes an image formation section 100 and a paper feed section 110. The image data are stored in a later-described control unit 102.

The image formation section 100 includes imaging units 101Y, 101M, 101C and 101K, a control unit 102, an intermediate transfer belt 103, a pair of secondary transfer rollers 104, a fixing device 105, a pair of exit rollers 106, an exit tray 107, a cleaner 108, and a pair of timing rollers 109.

Each of the imaging units 101Y, 101M, 101C, 101K is controlled by the control unit 102 and forms a toner image in a respective color, i.e., yellow (Y), magenta (M), cyan (C), or black (K). The toner images in the respective colors undergo static transfer (primary transfer), so as to be overlaid on the intermediate transfer belt 103. The intermediate transfer belt 103 is an endless rotating body that rotates in the direction shown by arrow A and carries the toner image resulting from the primary transfer to the pair of secondary transfer rollers 104.

The paper feed section 110 includes a paper feed cassette 111 that contains recording sheets P grouped according to their paper sizes, and supplies the recording sheets P to the image formation unit 100 one at a time. While the toner images are being carried by the intermediate transfer belt 103, the supplied recording sheet P is carried to the pair of secondary transfer rollers 104 via the pair of timing rollers 109. The timing rollers 109 are a pair of rollers, and adjust the timing at which the recording sheet P reaches the pair of secondary transfer rollers 104.

The secondary transfer rollers 104 are a pair of rollers, each at a different voltage, pressed against each other so as to form a transfer nip. The toner image on the intermediate transfer belt 103 undergoes a static transfer (secondary transfer) onto the recording sheet P at the transfer nip. The recording sheet P, with the toner image having been transferred thereto, is carried to the fixing device 105. After the secondary transfer, any toner remaining on the intermediate transfer belt 103 is scraped off by the cleaner 108 upon being carried by further travel in the direction of arrow A, and discarded.

The fixing device 105 utilizes electromagnetic induction heating. The fixing device 105 applies heat to, and thereby fuses, the toner image, and fixes the tonner image onto the recording sheet P by pressure. The recording sheet P with the toner image fused thereto is then made to exit onto the exit tray 107 by the exit rollers 106. The control unit 102 controls the operations of the image forming apparatus 1, including those described above.

[2] Structure Of Fixing Device 105

The configuration of the fixing device 105 is explained next.

Figure 2:
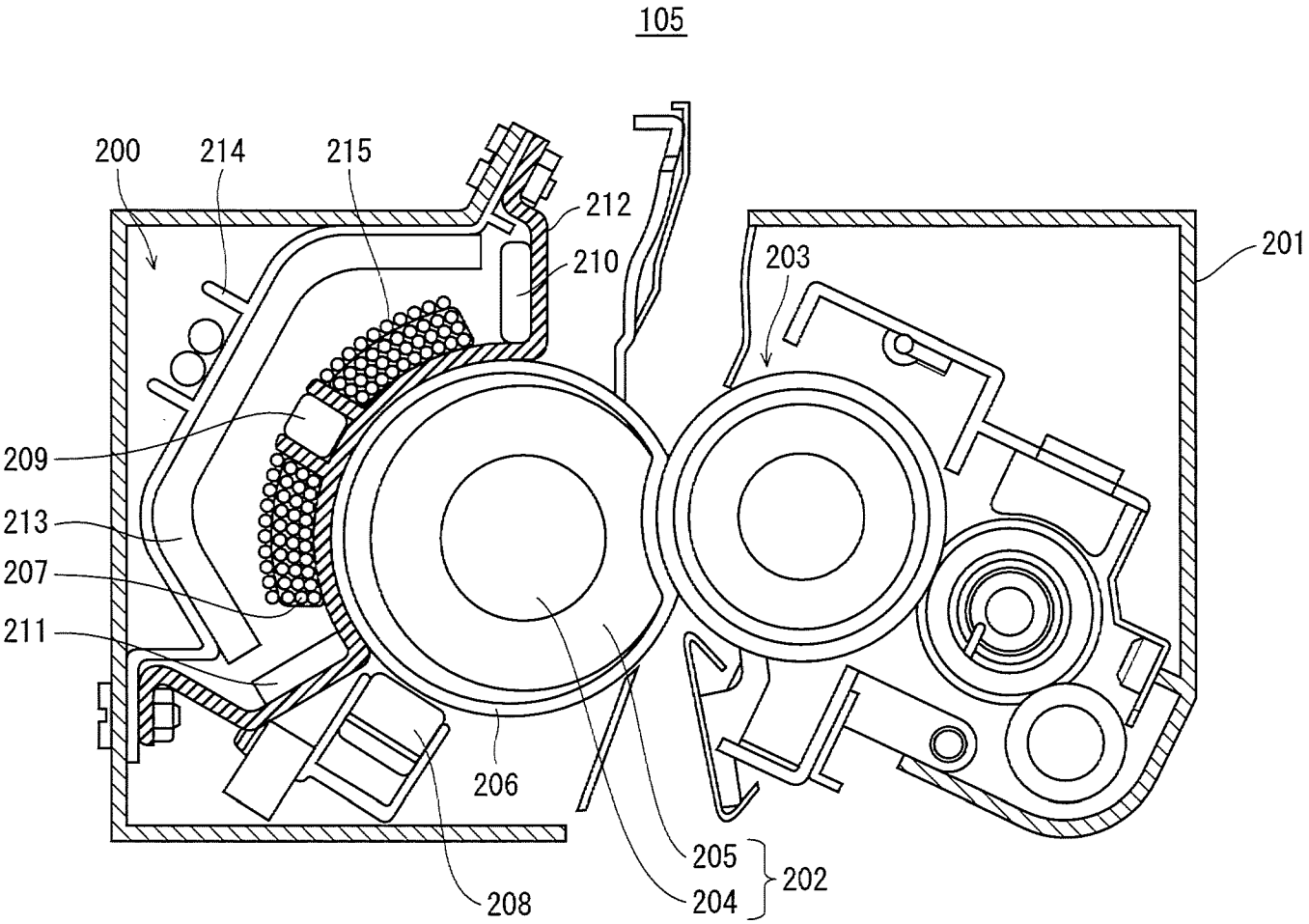
FIG. 2 is a cross-sectional view showing primary components of a fixing device 105.

FIG. 2 is a cross-sectional view showing primary components of the fixing device 105. As shown in FIG. 2, the fixing device 105 includes a casing 201, and an induction heating unit 200, a fixing roller 202, a pressurizing roller 203 and a fixing belt 206 which are housed within the casing 201.

The fixing roller 202 and the pressurizing roller 203 are both cylindrical rotating bodies, arranged such that the axes of rotation are parallel. The fixing roller 202 is made up of a core bar 204 with an insulating elastic layer 205 made of silicone sponge or similar formed over the outer surface thereof. The endless fixing belt 206 fits with slack over the fixing roller 202. The material of the core bar 204 may be, for example, non-magnetic stainless steel.

The pressurizing roller 203 is, for example, made up of a core bar with an elastic layer, a metallic layer, and a release layer layered thereon in the stated order. Any of electroformed Ni, stainless used steel (SUS), an Fe alloy, an Al alloy, a Cu alloy, or similar may be used. To prevent adhesion of toner to the pressurizing roller 203 and improving the image quality, the release layer may be made up of Per-Fluoro-Alkoxy (PFA) powder resin, PFA dispersion coating material, PFA/Ploy-Tetra-Fluoro-Ethylene (PTFE) admixture dispersion coating material, or a PFA tube. For the elastic layer, any silicone rubber or silicone sponge having low thermal conductivity may be used. As such, dispersion of heat from the metallic layer to the core bar is prevented, and the power consumption of the fixing device 105 is constrained.

The pressurizing roller 203 is pressed into the fixing belt 206 by a non-diagrammed pressurizing mechanism. Accordingly, the nip width required for fixing is mainly preserved by deformation of the insulating elastic layer 205 of the fixing roller 202. The pressurizing roller 203 is driven to rotate by a non-diagrammed drive motor. The fixing belt 206 is, in turn, driven by pressure and friction from the pressurizing roller 203. The fixing roller 202 is also made to rotate, following the rotation of the fixing belt 206. Accordingly, the toner image is fixed as the recording sheet P is carried.

Figure 3:
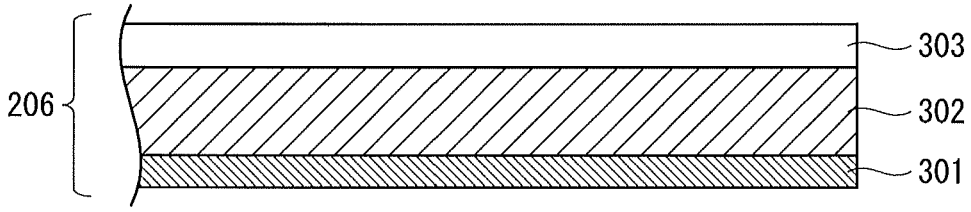
FIG. 3 is a cross-sectional view showing a structure of a fixing belt 206.

As shown in FIG. 3, the fixing belt 206 is made up of a metallic heating layer 301, an elastic layer 302, and a release layer 303, layered in the stated order of proximity to the fixing roller 202. The metallic heating layer 301 is composed of an electroformed Ni sleeve, and undergoes Joule heating due to the induction current produced by the alternating magnetic flux produced by the induction heating unit 200 passing therethrough. The elastic layer 302 is composed of silicone rubber. The release layer 303 is a PFA resin tube.

An IR sensor 208 is disposed in proximity to the outer surface of the fixing belt 206 so as to measure the surface temperature at the near-center of the axis of rotation of the fixing belt 206, without direct contact. The control unit 102 receives a temperature signal from the IR sensor 208 and controls the alternating flux produced by the induction heating unit 200 such that the fixing belt 206 remains at a predetermined fixing temperature.

The induction heating unit 200 includes a magnetizing coil 207, demagnetizing coils 215, a center core 209, a main core 213, hem cores 210 and 211, a coil bobbin 212, and a core holding member 214. The magnetizing coil 207, the center core 209, and the hem cores 210 and 211 are held in the coil bobbin 212. The main core 213 having a rib-like shape is held by the core holding member 214. The demagnetizing coils 215 are bonded and fixed to the magnetizing coil 207 via an insulation sheet. The coil bobbin 212 and the core holding member 214 are screwed to the casing 201 of the fixing device 105.

The magnetizing coil 207 has an active heating length that matches the sheet-passing width of the largest recording sheet size handled by the image forming apparatus 1. The active heating length is the size of the area of the fixing belt 206 that can be heated up to the fixing temperature, and describes a length with respect to the axis of rotation of the fixing belt 206.

The center core 209, the hem cores 210 and 211, and the main core 213 are magnetic bodies having high permeability and low loss, made of an alloy such as ferrite or permalloy. The cores form a magnetic circuit in combination with the fixing belt 206 and the magnetizing coil 207. Accordingly, flux leakage outside the magnetic circuit is screened, thus improving thermal efficacy.

The magnetizing coil 207 is connected to a non-diagrammed high-frequency inverter and generates an alternating magnetic field from the high-frequency electric power supplied thereto, at 10 kHz to 100 kHz and 100 W to 2000 W. To this end, the magnetizing coil 207 ideally has litz wire winding therearound. These litz wires are bundles of fine copper wire, covered in heat-resistant resin. In the present embodiment, the individual wires have a diameter of 0.17 mm, and 114 wires, twisted together into a single litz wire, are wound around the magnetizing coil 207 for 10 turns.

Figure 4:
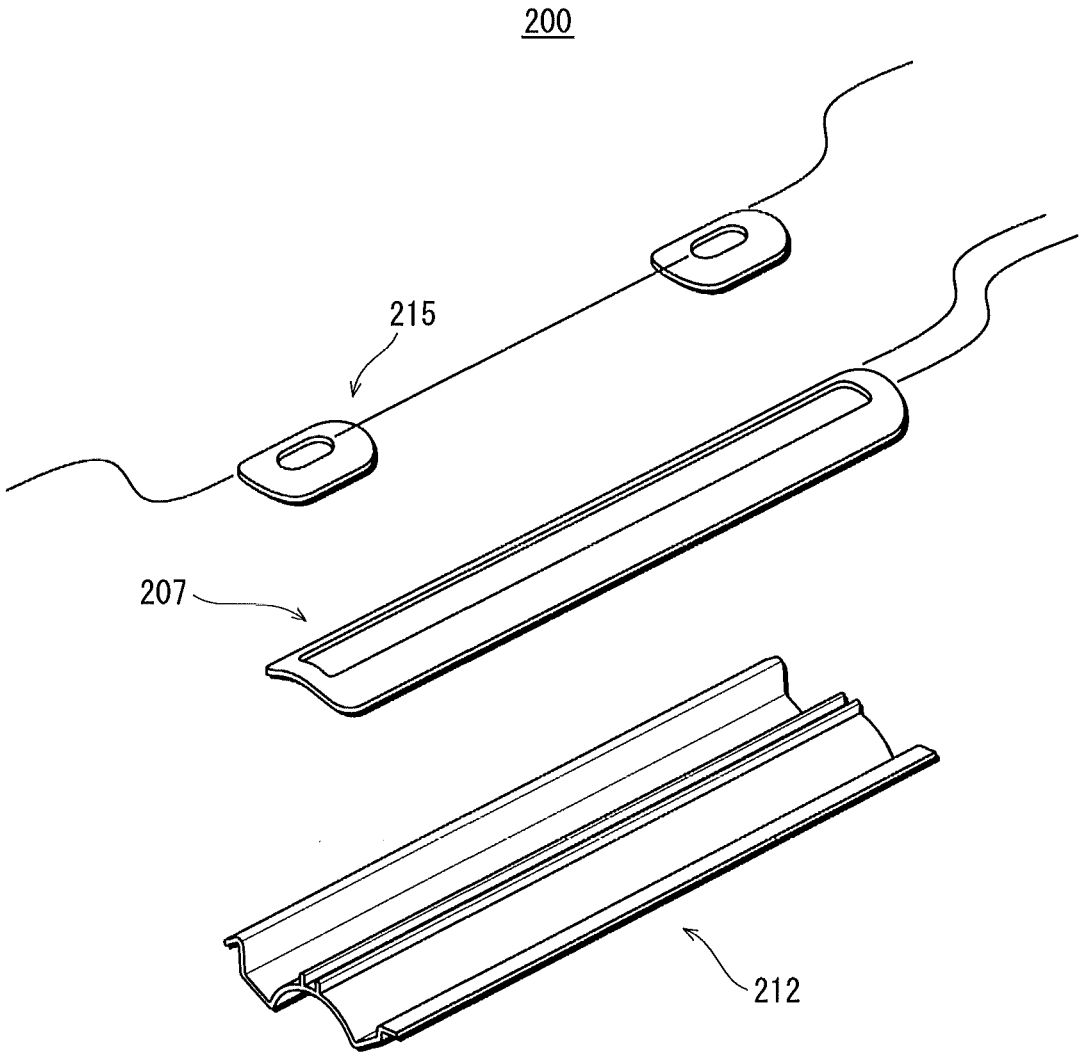
FIG. 4 is an exploded perspective view showing the positional relationship between a magnetizing coil 207 and demagnetizing coils 215.

Also, the demagnetizing coils 215 are respectively disposed at either edge of the fixing belt 206, with respect to the axis of rotation, at positions above the magnetizing coil 207 corresponding to the non-sheet passing region for a small paper size. FIG. 4 is an exploded perspective view showing the positional relationship between the magnetizing coil 207 and the demagnetizing coils 215. As shown in FIG. 4, the demagnetizing coils 215 are disposed at either end of the magnetizing coil 207 in the longitudinal direction. In FIG. 4, each of the two demagnetizing coils 215 has lead lines extending from the start and end of the winding, and the demagnetizing coils 215 are connected in series. Therefore, the operations for turning on and off the two demagnetizing coils 215 are integrally controlled. However, the two demagnetizing coils 215 may be controlled separately.

Figure 5:
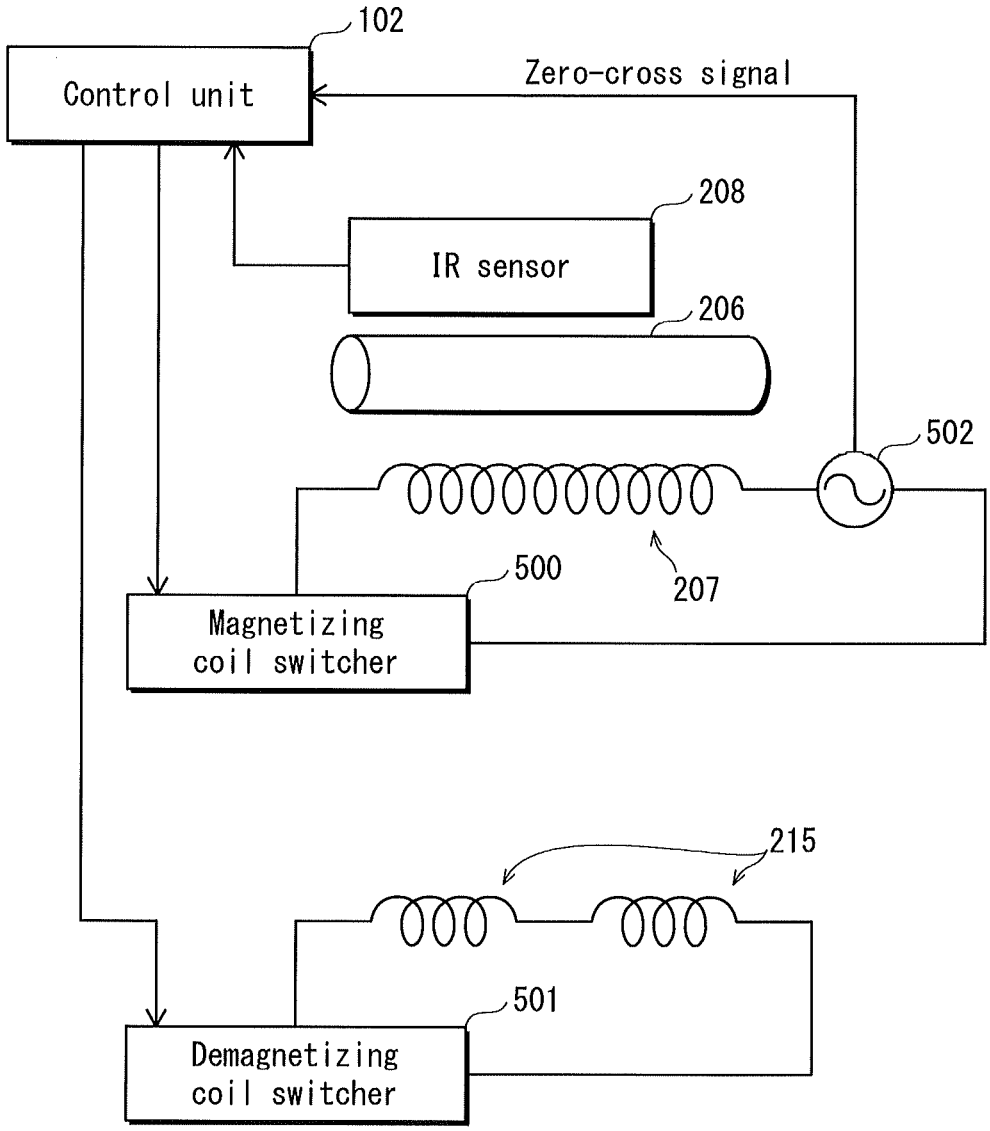
FIG. 5 shows a circuit configuration used for controlling the magnetizing coil 207 and the demagnetizing coils 215.

FIG. 5 shows the circuit configuration used for controlling the magnetizing coil 207 and the demagnetizing coils 215. As shown in FIG. 5, the magnetizing coil 207 is connected to an AC power source 502 via a magnetizing coil switcher 500. Also, the demagnetizing coils 215 form a loop circuit connected in series to a demagnetizing coil switcher 501. The magnetizing coil switcher 500 and the demagnetizing coil switcher 501 are both under control of the control unit 102.

At image formation, the control unit 102 switches the magnetizing coil switcher 500 to on, thus energizing the magnetizing coil 207 to perform electromagnetic induction heating. Simultaneously, the control unit 102 monitors the temperature of the non-sheet passing region of the fixing belt 206 by using the IR sensor 208. When the temperature of the non-sheet passing region reaches a predetermined temperature, the control unit 102 turns on the demagnetizing coil switcher 501 in synchronization with a zero-cross signal output by the AC power source 502, and causes the demagnetizing coils 215 to produce an inverse flux. The flux produced by the magnetizing coil 207 is thereby cancelled out, thus controlling the heating of the non-sheet passing region.

Returning to FIG. 4, the main core 213 is bent into a trapezoidal shape so as to cover the outer surface of the magnetizing coil 207. Up to a dozen or so main cores 213, disposed at equal intervals along a direction parallel to the axial direction of the fixing roller 202, are held by the core holding member 214. Among the plurality of main cores 213, those disposed at either end with respect to the axial direction raising the magnetic coupling of the ends in order to supplement the dispersion of heat from the ends of the fixing belt 206.

Also, the center core 209 and the hem cores 210 and 211 are each formed so as to be elongated in a direction parallel to the axis of rotation of the fixing roller 202. The center core 209 and the hem cores 210 and 211 are attached to the coil bobbin 212 by a silicon adhesive or similar heat-resistant adhesive. The hem cores 210 and 211 may be discrete with respect to the axial direction, but must be aligned such that no gaps are present.

The center core 209 guides the flux produced by the magnetizing coil 207 to the fixing belt 206 so as to achieve a uniform flux density. Eddy currents are induced in the fixing belt 206 by the flux passing therethrough. The fixing belt 206 thus undergoes Joule heating. The coil bobbin 212 and the core holding member 214 are attached by nuts and bolts in the hem portions thereof. The nuts and bolts may be replaced by rivets or the like.

[3] Demagnetizing Coil Switcher 501

The structure of the demagnetizing coil switcher 501 is described next.

(3-1) Structure of Demagnetizing Coil Switcher 501

Figure 6:
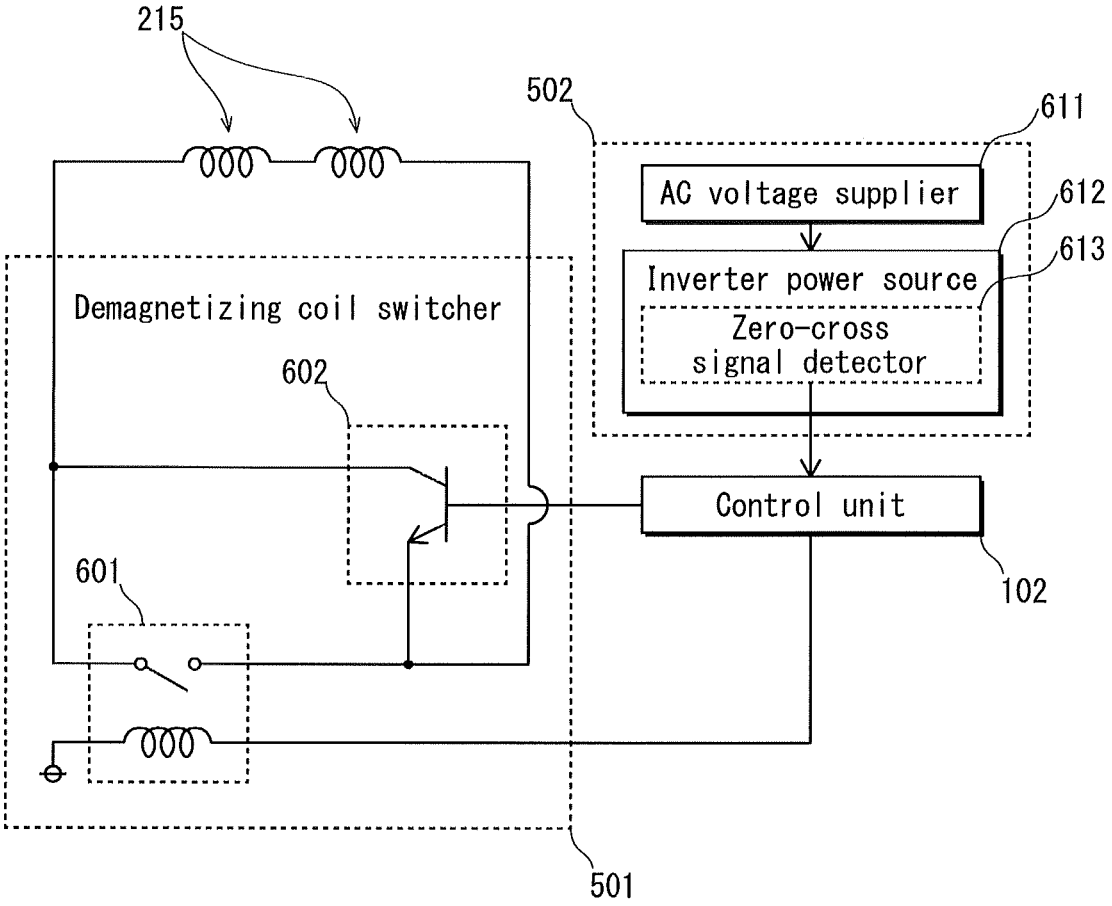
FIG. 6 is a circuit diagram showing primary components of a demagnetizing coil switcher 501.

As shown in FIG. 6, the demagnetizing coil switcher 501 is composed of a contact switch 601 and a semiconductor switch 602 electrically connected in parallel. Each of the contact switch 601 and the semiconductor switch 602 is individually turned on or off under the control of the control unit 102. The contact switch 601 and the semiconductor switch 602 may be integrated as one piece and mounted on the substrate or the like, or be mounted as separate parts.

According to the present embodiment, the contact switch 601 is a package into which a contact and a solenoid are integrated. Specifically, the contact switch 601 is a magnetic switch that closes the contact when current flows through the solenoid, and opens the contact when the current flowing through the solenoid is interrupted.

As described below, the semiconductor switch 602 needs to be turned on or off in synchronization with a zero-crossing, and accordingly needs to operate quickly. Depending on the required accuracy of the synchronization with the zero-crossings, the semiconductor switch 602 might be supplied with high voltage when the demagnetizing coils 215 are in the cutoff state, and therefore the semiconductor switch 602 needs to be resistant to high voltage. For this reason, the present embodiment uses an insulated gate bipolar transistor (IGBT) as the semiconductor switch 602.

The AC power source 502 is composed of an AC voltage supplier 611 and an inverter power source 612. In the present embodiment, a zero-cross signal detector 613 is incorporated in the inverter power source 612. The zero-cross signal detector 613 may be separated from the inverter power source 612.

The zero-cross signal detector 613 detects a zero-crossing at which the AC voltage output by the AC voltage supplier 611 becomes zero, and generates a zero-cross signal according to the detection. According to the present embodiment, the zero-cross signal has a pulse waveform representing the 0-volt points of the voltage waveform resulting from full-wave rectification of the AC voltage.

The zero-cross signal may be generated by predicting the zero-crossings through analysis of the waveform of the AC voltage output by the inverter power source 612. The degree of accuracy in predicting the zero-crossings must be set such that the semiconductor switch 601 can withstand the voltage generated by the arc phenomenon or the back electromotive force.

When there is a phase difference between the AC voltage output by the AC power source 502 and the AC voltage occurring in the demagnetizing coils 215, the control unit 102 opens or closes the semiconductor switch 602 with timing shifted by the phase difference. This correction may be performed by the zero-cross signal detector 613 instead of by the control unit 102.

The zero-cross signal is of course detected every half period of the AC voltage. According to the present embodiment, the period of the AC voltage, which determines the period of the zero-cross signal, depends on the frequency of the power source used by the image forming apparatus 1. When the frequency rating of the power source is 50 Hz, the period of the zero-cross signal is approximately 10 ms. In the following, it is assumed that the frequency rating of the power source is 50 Hz.

(3-2) Operations of Demagnetizing Coil Switcher 501

The operations of the demagnetizing coil switcher 501 are described next.

Figure 7:
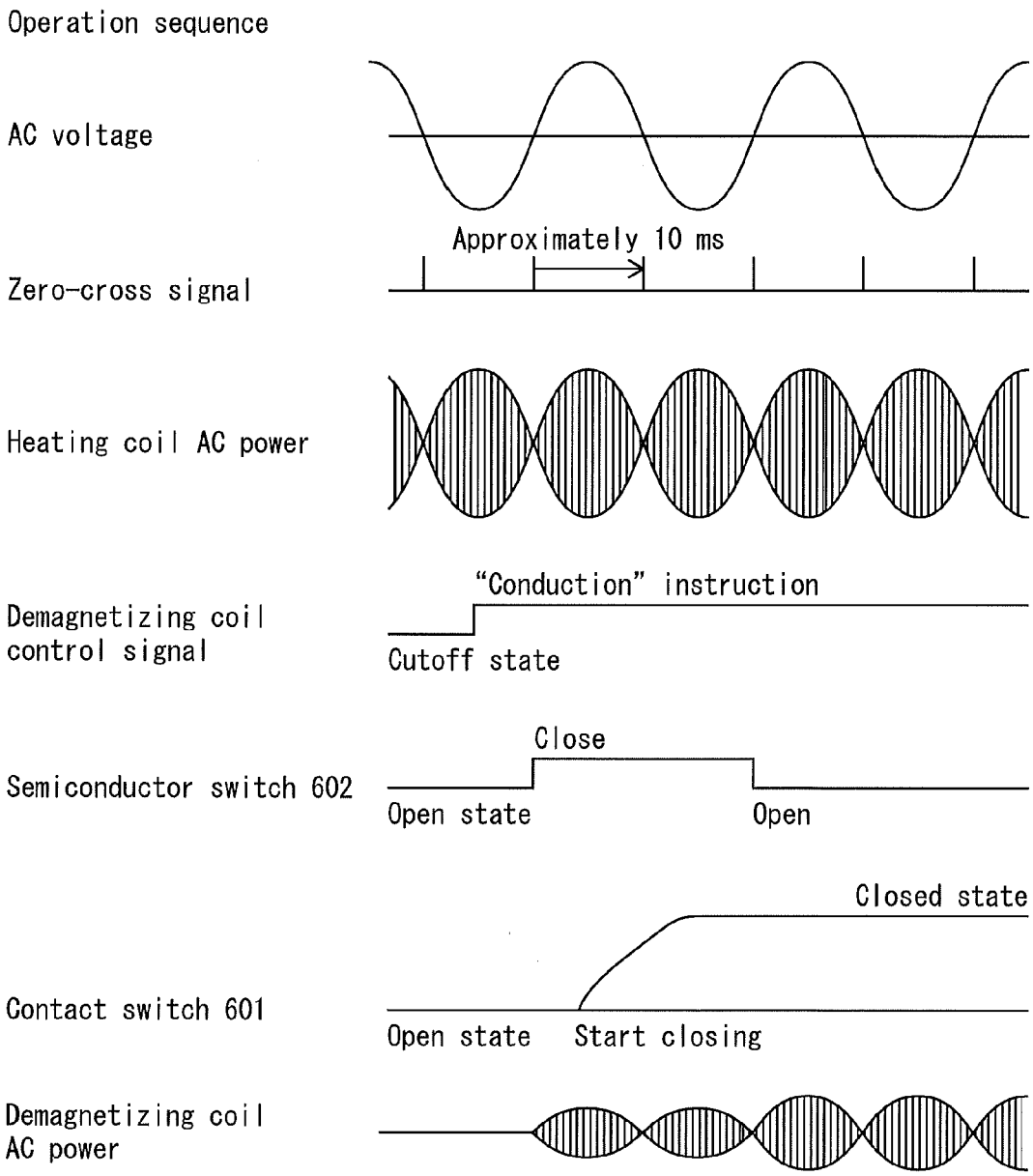
FIG. 7 is a sequence diagram showing the operations of a semiconductor switch 602 and a contact switch 601 of the demagnetizing coil switcher 501 performed for bringing the demagnetizing coils 215 into the conductive state.

FIG. 7 is a sequence diagram showing the operations of the semiconductor switch 602 and the contact switch 601 when bringing the demagnetizing coils 215 into the conductive state. When equal to or more than a predetermined number of small sheets have been continuously transported or when the temperature of the non-sheet passing region, where small sheets do not pass through, reaches or exceeds a predetermined temperature, an instruction to bring the demagnetizing coils 215 into their conductive state is made with a demagnetizing coil control signal. In response to this instruction, the control unit 102 first brings the semiconductor switch 602 into the conductive state in synchronization with the zero-cross signal detected by the zero-cross signal detector 613.

Since the semiconductor switch 602 requires only a short period to switch, switching in synchronization with the zero-crossings prevents deterioration and damage resulting from application of high voltage. Next, the control unit 102 closes the contact switch 601 while maintaining the semiconductor switch 602 closed. Since no high voltage is applied to the contact switch 601 while the semiconductor switch 602 is closed, and the contact switch 601 is prevented from being deteriorated or fused by the arc phenomenon.

After closing the contact switch 601, the control unit 102 opens the semiconductor switch 602. If the semiconductor switch 602 is kept closed continuously, it will generate heat due to the on-resistance, and can be deteriorated or damaged. However, keeping the semiconductor switch 602 closed only while the contact switch 601 is being closed prevents the problems caused by the heat. Furthermore, the stated operations prevent the degradation in efficiency of the demagnetizing resulting from the loss caused by the on-resistance of the semiconductor switch 602.

Figure 8:
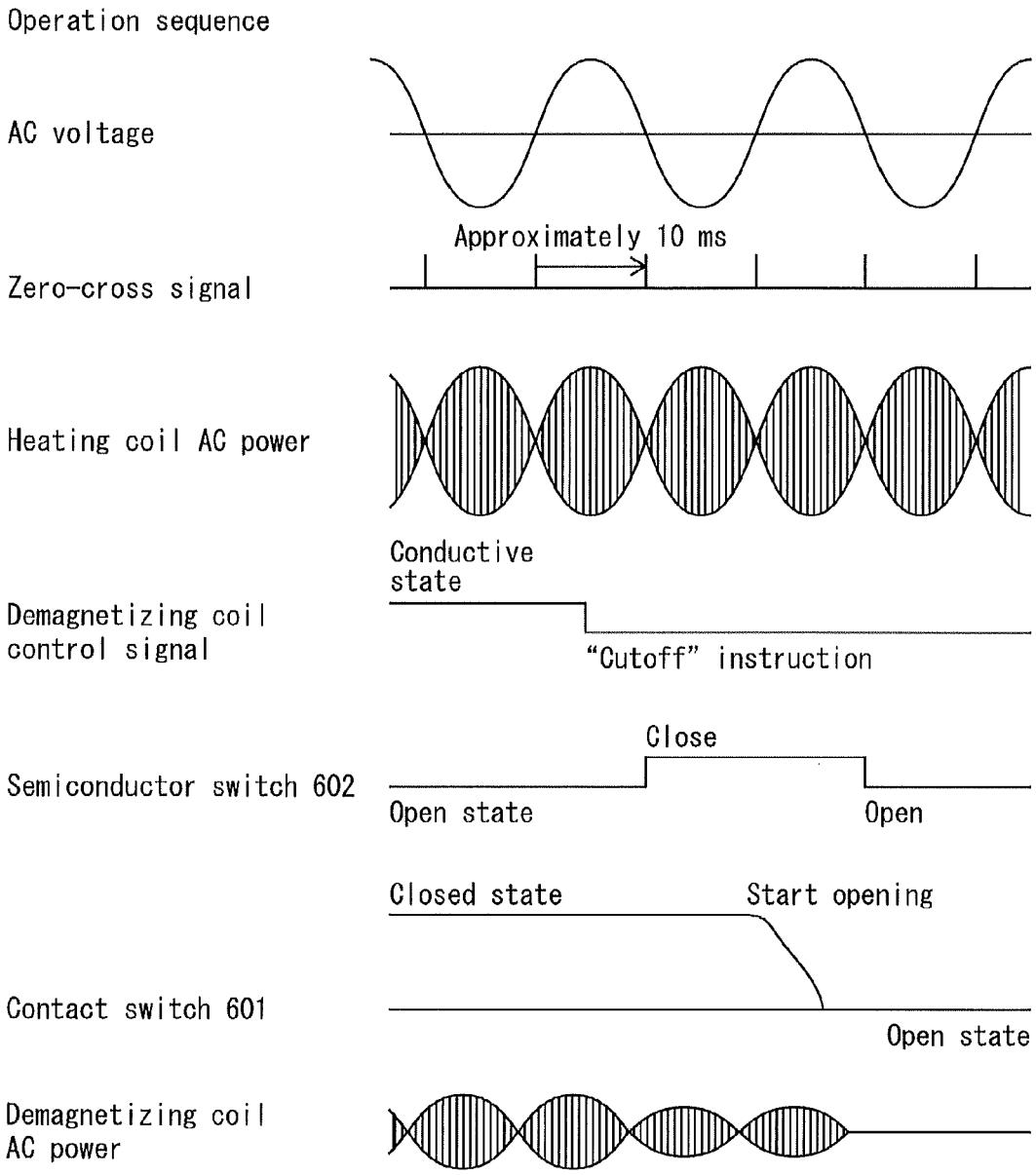
FIG. 8 is a sequence diagram showing the operations of the semiconductor switch 602 and the contact switch 601 performed for bringing the demagnetizing coils 215 into the cutoff state.

FIG. 8 is a sequence diagram showing the operations of a sequence diagram showing the operations of the semiconductor switch 602 and the contact switch 601 when bringing the demagnetizing coils 215 into the cutoff state. When the temperature of the non-sheet passing region drops to or below a predetermined temperature, an instruction to bring the demagnetizing coils 215 into the cutoff state is made by using a demagnetizing coil control signal. In response to this instruction, the control unit 102 first closes the semiconductor switch 602 in synchronization with the zero-cross signal detected by the zero-cross signal detector 613. Next, the control unit 102 opens the contact switch 601, keeping the semiconductor switch 602 closed.

After closing the contact switch 601, the control unit 102 opens the semiconductor switch 602. As described above, the semiconductor switch 602 is kept closed only until the contact switch 601 has been completely opened. Therefore, deterioration and damage caused by the heat generated by the semiconductor switch 602 are prevented. Furthermore, the stated operations prevent the degradation in efficiency of the demagnetizing resulting from the loss caused by the on-resistance of the semiconductor switch 602. In addition, as with the case of bringing the demagnetizing coils 215 into its conductive state, the contact switch 601 is prevented from being deteriorated or fused.

Therefore, the above-described operations for bringing the demagnetizing coils 215 into the conductive or cut-of state eliminate the necessity of reducing the paper conveyance speed or of stopping the output from the magnetizing coil 207 when conveying small sheets, and prevent the degradation of the processing efficiency that would be caused by the prevention of the overheating of the non-sheet passing region.

Figure 9:
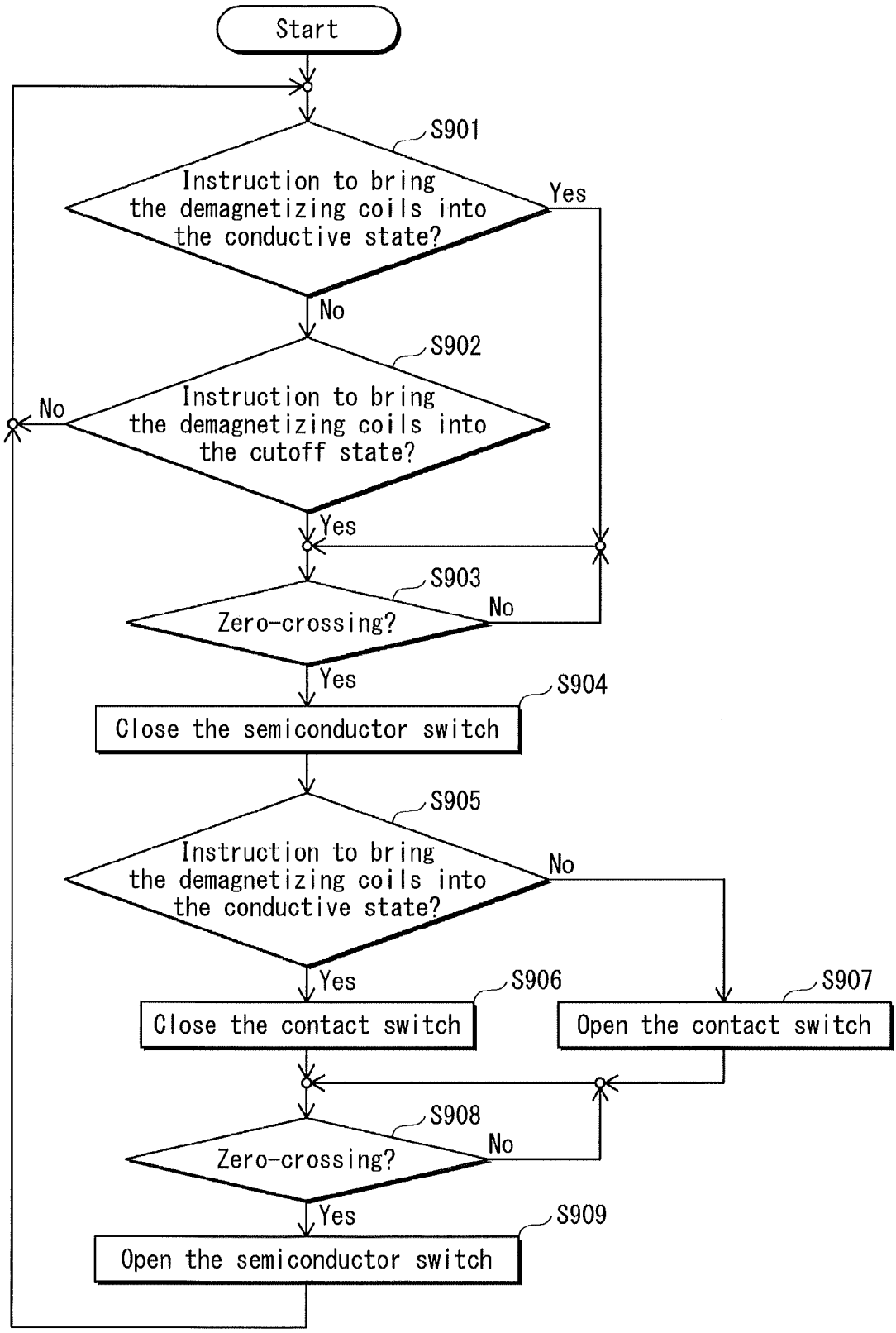
FIG. 9 is a flowchart schematically showing control operations performed by the control unit 102.

FIG. 9 is a flowchart summarizing the control operations of the control unit 102. As shown in FIG. 9, upon receiving an instruction to bring the demagnetizing coils 215 into the conductive state (S901: YES) or an instruction to bring the demagnetizing coils 215 into the cutoff state (S902: YES), the control unit 102 synchronizes to a zero-crossing (S903: YES), and closes the semiconductor switch 602 (S904).

After closing the semiconductor switch 602, when receiving the instruction to bring the demagnetizing coils 215 into the conductive state (S905: YES), the control unit 102 closes the contact switch 601 (S906). If there is no instruction to bring the demagnetizing coils 215 into the conductive state (S905: NO), the control unit 102 opens the contact switch 601 (S907). Subsequently, the control unit 102 synchronizes to a zero-crossing (S906: YES), and opens the semiconductor switch 602 (S909).

[4] Modification Examples

The present invention has been described above based on an embodiment. However, the present invention is not limited to the embodiment. The following modifications are acceptable.

(1) According to the embodiment described above, the conductive state of the demagnetizing coils 215 is maintained when the non-sheet passing region is overheated. However, the present invention is not limited in such a way. To suppress the temperature rise in the non-sheet passing region by repeatedly bringing the demagnetizing coils 215 into the conductive state and the cutoff state, the following modification may be applied to the embodiment.

Figure 10:
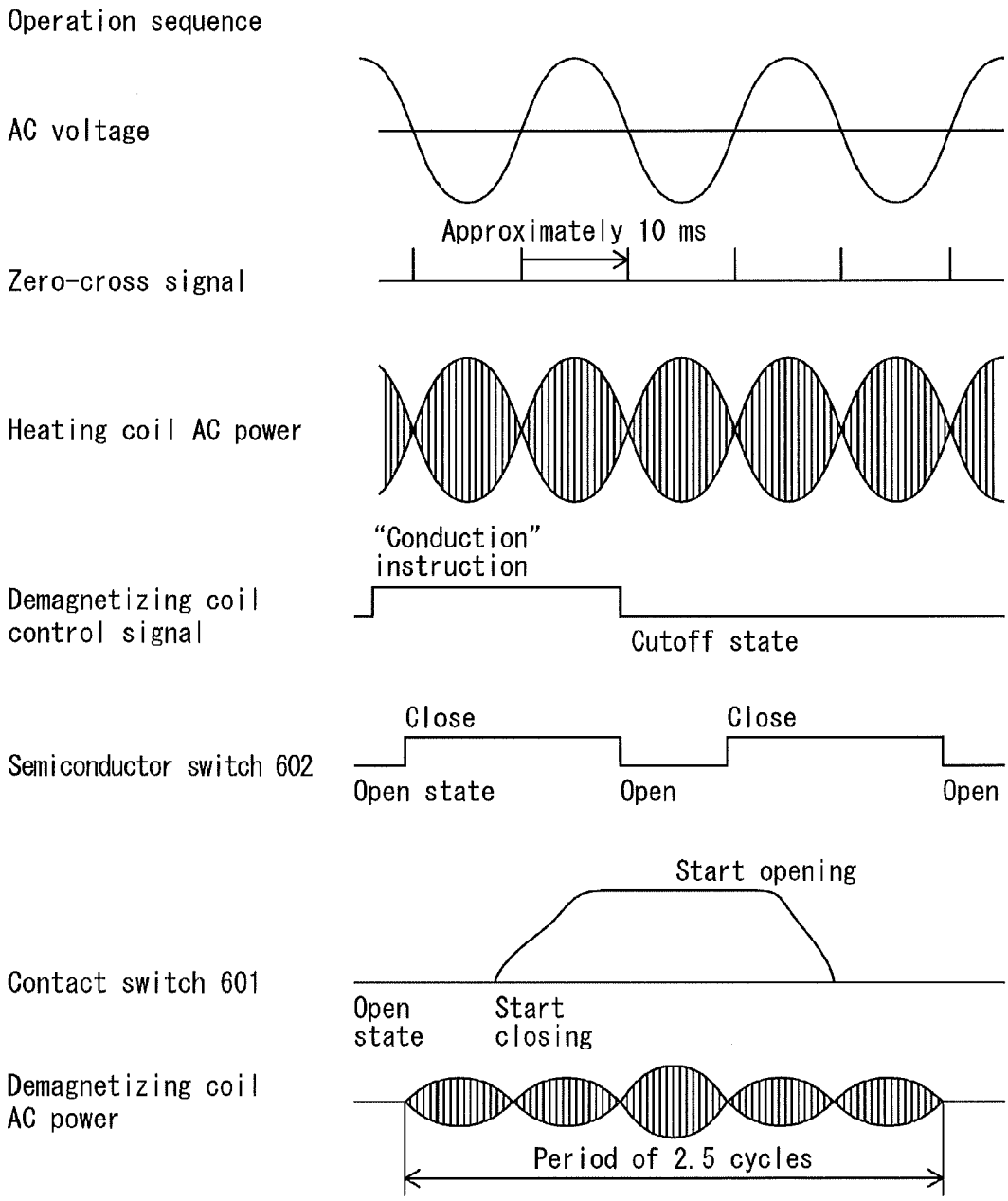
FIG. 10 is a sequence diagram showing the operations of repeatedly bringing the demagnetizing coils 215 into the conductive state and into the cutoff state according to the control discussed in Embodiment.

FIG. 10 is a sequence diagram showing the operations of repeatedly bringing the demagnetizing coils 215 into the conductive state and the cutoff state according to the control discussed in Embodiment above (cf. FIG. 9). As shown in FIG. 10, in the control according to the embodiment described above, the control unit 102 can bring the demagnetizing coils 215 into the conductive state or the cutoff state in the shortest period by opening the semiconductor switch 602 in synchronization with the zero-crossing that occurs immediately after the contact switch 601 has been closed.

Next, the control unit 102 closes the semiconductor switch 602 again in synchronization with the immediately subsequent zero-crossing, and then opens the contact switch 601. Therefore, the time from when the semiconductor switch 602 is initially closed to when the semiconductor switch 602 is lastly opened equals to the period of 2.5 cycles of the AC voltage.

Figure 11:
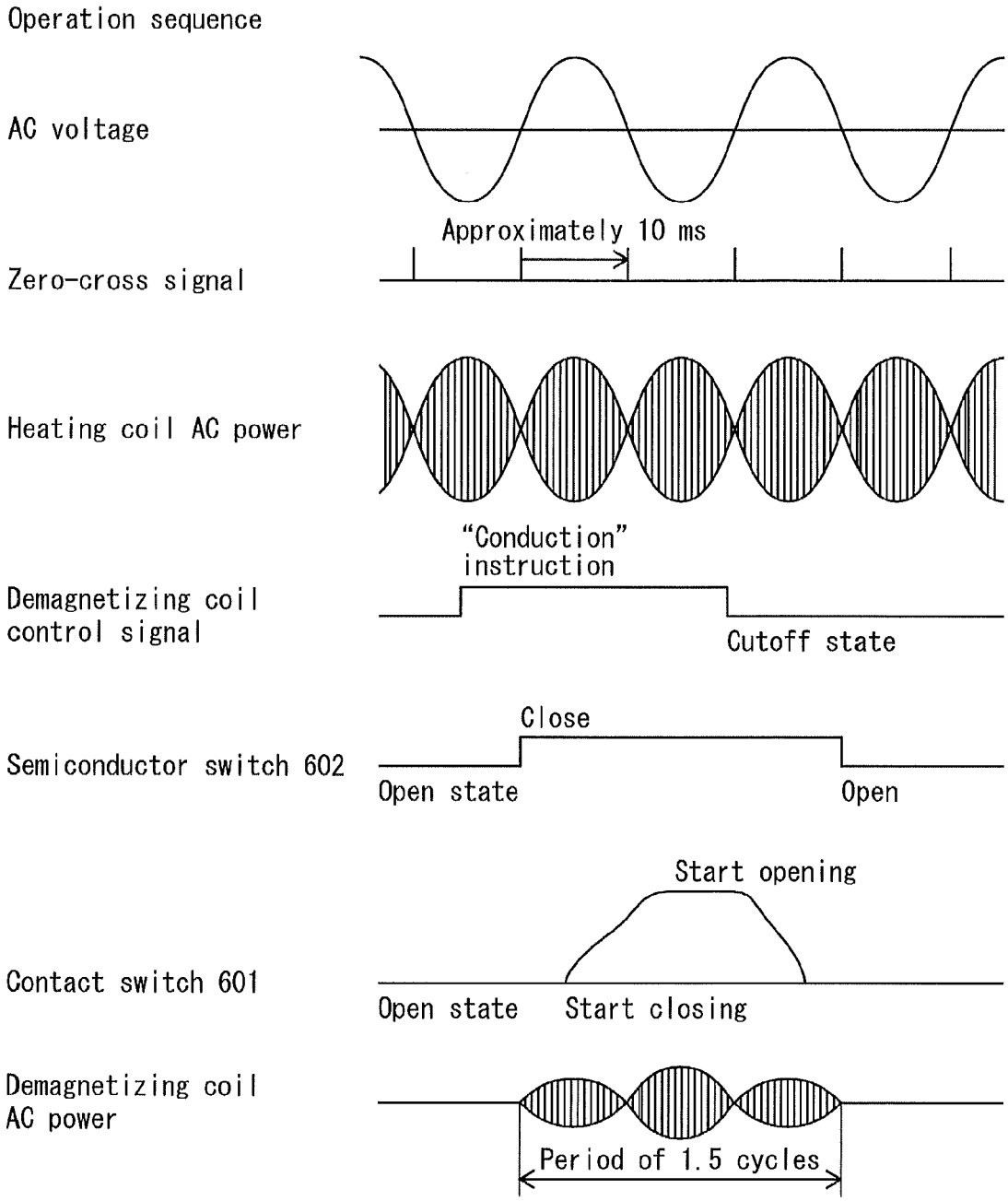
FIG. 11 is a sequence diagram showing control operations pertaining to a modification of the present invention.

FIG. 11 is a sequence diagram showing control operations pertaining to another modification. According to this modification, the control unit 102, after closing the contact switch 601, immediately opens the contact switch 601 without closing the semiconductor switch 602, as shown in FIG. 11. The control unit 201 opens the semiconductor switch 602 in synchronization with the immediately subsequent zero-crossing.

With these operations, the time required since closing the semiconductor switch 602 until opening the semiconductor switch 602 can be reduced to the period of 1.5 cycles of the AC voltage. Therefore, when the operations of bringing the demagnetizing coils 215 into the conductive state and into the cutoff state have the same duty ratio, both the conductive period and the cutoff period of the demagnetizing coils 215 will be shorter than the case according to the embodiment described above (FIG. 10). Hence, the stated operations suppress the changes in the temperature of the non-sheet passing region.

Even in this case, the contact switch 601 is prevented from being deteriorated or fused by bringing the demagnetizing coils 215 into the conductive state and the cutoff state. Furthermore, since the semiconductor switch 602 is not kept closed for a long period, the semiconductor switch 602 is also prevented from being deteriorated or damaged.

Figure 12:
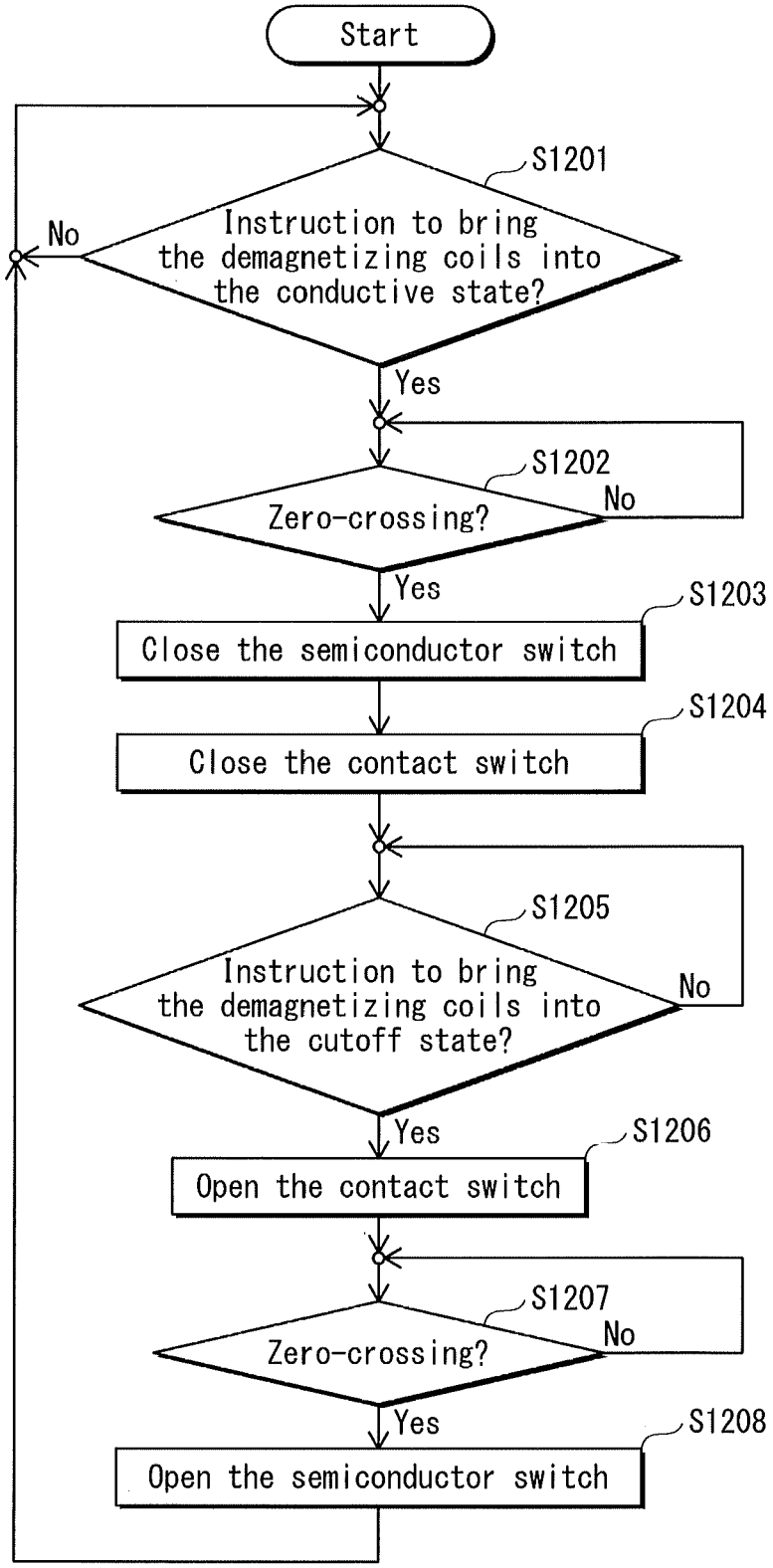
FIG. 12 is a flowchart showing operations of the control unit 102 pertaining to the modification of the present invention.

FIG. 12 is a flowchart showing the control performed by the control unit 102 in order to achieve the above-described operations. As shown in FIG. 12, upon receiving an instruction to bring the demagnetizing coils 215 into the conductive state (S1201: YES), the control unit 102 synchronizes to a zero-crossing (S1202: YES) and closes the semiconductor switch 602 (S1203), and subsequently closes the contact switch 601 (S1204). After that, upon receiving an instruction to bring the demagnetizing coils 215 into the cutoff state (S1205: YES), the control unit 102 immediately opens the contact switch 601 (S1206), synchronizes to a zero-crossing (S1207: YES), and then opens the semiconductor switch 602 (S1208). Subsequently, the control unit 102 moves to Step S1201 and repeats the operations described above.

Figure 13:
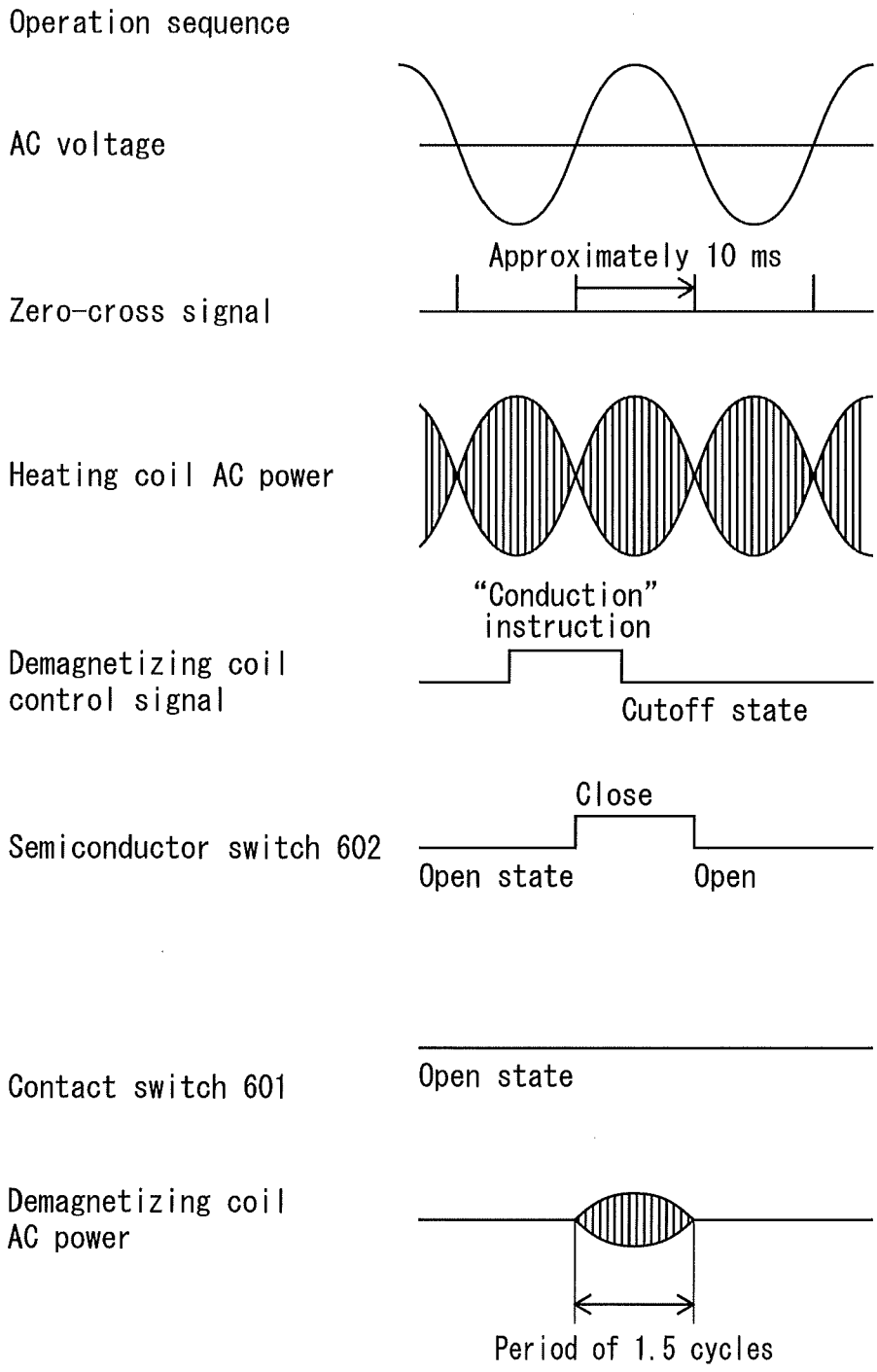
FIG. 13 is a sequence diagram showing control operations pertaining to another modification of the present invention.

FIG. 13 is a sequence diagram showing other control operations pertaining to the present modification. In FIG. 13, the control unit 102 first closes the semiconductor switch 602 in synchronization with a zero-crossing, and then opens the semiconductor switch 602 in synchronization with the immediately subsequent zero-crossing without closing the contact switch 601. According to these operations, the control unit 102 can close and open the semiconductor switch 602 in the half period of the AC voltage, and it is therefore possible to switching the demagnetizing coils 215 between the conductive state and the cutoff state in an even shorter period.

Therefore, when the operations of bringing the demagnetizing coils 10 into the conductive state and into the cutoff state have the same duty ratio, both the conductive period and the cutoff period of the demagnetizing coils 215 will be shorter than the case according to the embodiment described above (FIG. 10 and FIG. 11). Hence, the stated operations suppress the changes in the temperature of the non-sheet passing region. This provides further improved flexibility in changing the duty ratios.

In addition, as a matter of course, the contact switch 601 is free from deterioration, because the contact switch 601 does not operate. Furthermore, the semiconductor switch 602 is prevented from being deteriorated or damaged because the semiconductor switch 602 is not kept closed either.

Figure 14:
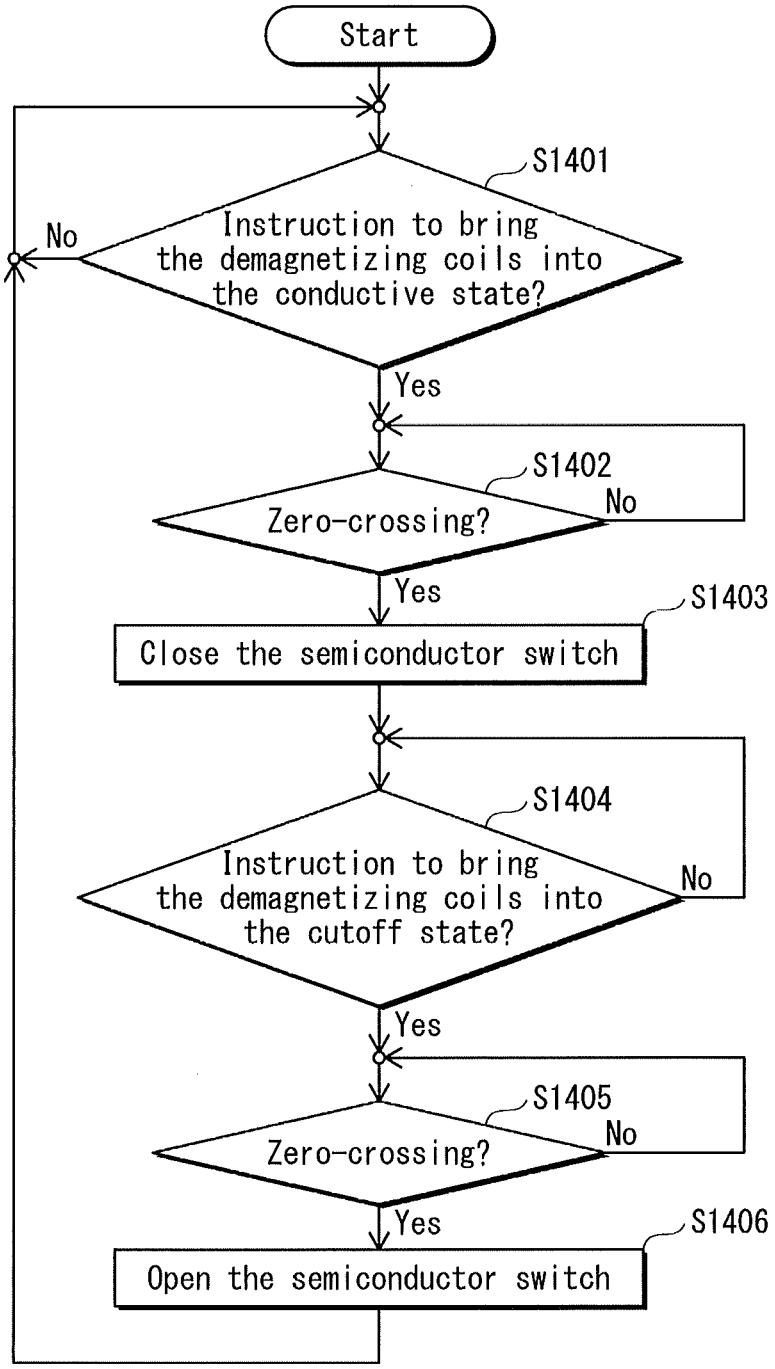
FIG. 14 is a flowchart showing operations of the control unit 102 pertaining to another modification of the present invention.
Figure 15:
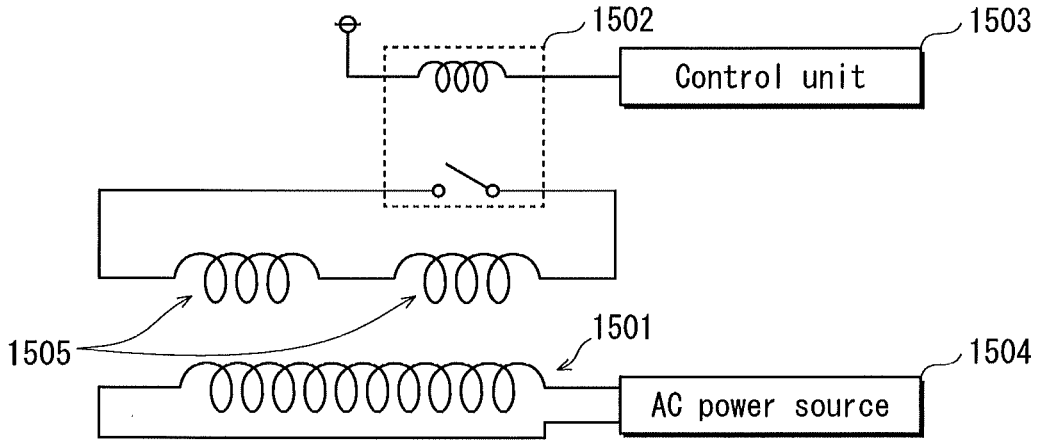
FIG. 15 Prior Art
FIG. 15 is a circuit diagram showing a conventional technology using a contact switch.
Figure 16:
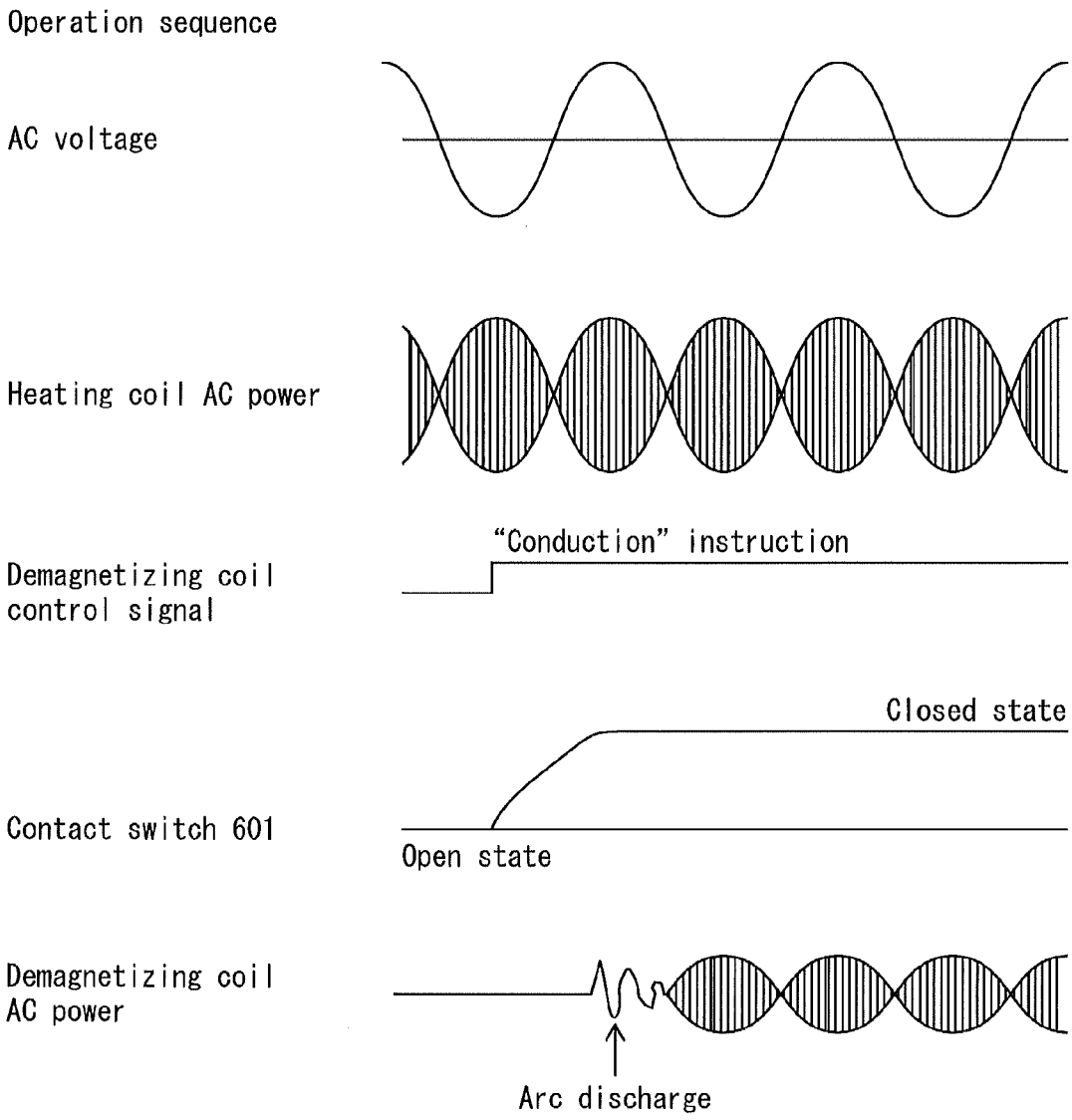
FIG. 16 Prior Art
FIG. 16 is a sequence diagram showing the operations of bringing demagnetizing coils into the conductive state according to a conventional technology using a contact switch.
Figure 17:
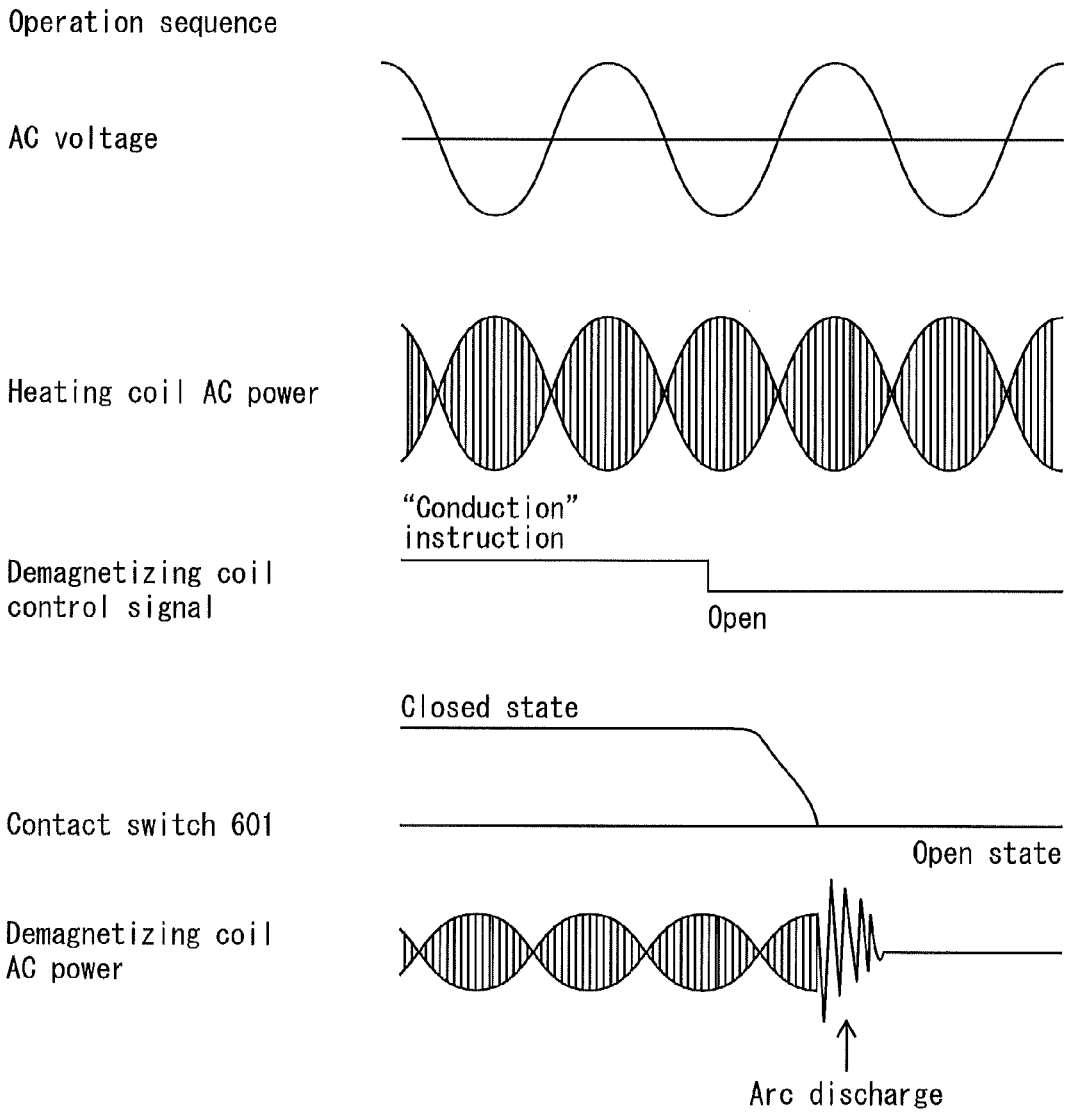
FIG. 17 Prior Art
FIG. 17 is a sequence diagram showing the operations of bringing demagnetizing coils into the cutoff state according to a conventional technology using a contact switch.
Figure 18:
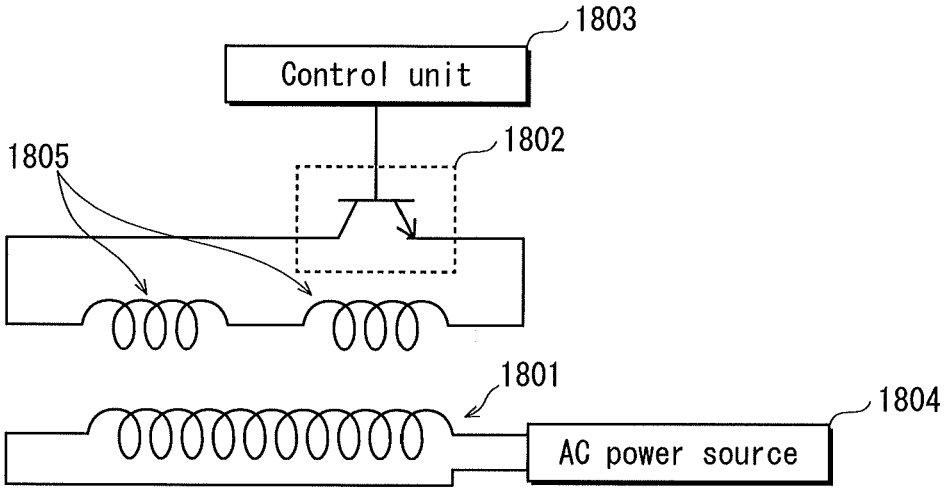
FIG. 18 Prior Art
FIG. 18 is a circuit diagram showing a conventional technology using a semiconductor switch.

FIG. 14 is a flowchart showing the control performed by the control unit 102 in order to achieve the above-described operations. As shown in FIG. 14, upon receiving an instruction to bring the demagnetizing coils 215 into the conductive state (S1401: YES), the control unit 102 synchronizes to a zero-crossing (S1402: YES), and closes the semiconductor switch 602 (S1403). After that, upon receiving an instruction to bring the demagnetizing coils 215 into the cutoff state (S1404: YES), the control unit 102 synchronizes to a zero-crossing (S1405: YES), and opens the semiconductor switch 602 (S1406). Subsequently, the control unit 102 moves to StepS 1401 and repeats the operations described above.

(2) According to the embodiment described above, the control unit 102 starts opening or closing the contact switch 601 immediately after closing the semiconductor switch 602 in synchronization with a zero-crossing, and closes the semiconductor switch 602 in synchronization with the immediately subsequent zero-crossing. However, this is not essential for the present invention, and the timing of operating the contact switch 601 and the semiconductor switch 602 may be different from the embodiment.

Specifically, if the period for which the semiconductor switch 602 is kept closed is short enough, the period between when the semiconductor switch 602 is closed and when the contact switch 601 is closed or opened may be shorter than the embodiment described above. Similarly, the period between when the contact switch 601 has been completely opened or closed and when the semiconductor switch 602 is opened may be longer compared to the embodiment described above.

Such a control also achieves the advantageous effect of the present invention. To improve the demagnetizing effect, it is preferable to reduce the period for which the semiconductor switch 602 is kept closed as much as possible.

(3) According to the embodiment described above, the image forming apparatus is a tandem color printer. However, this is not essential for the present invention. The present invention may be applied to non-tandem color printers or monochrome printers. Furthermore, it is possible to achieve the same advantageous effects by applying the present invention to copy machines having a document scanner, facsimile machines having a communication function, or multi-function peripherals (MFPs) having the functions of both copy machines and facsimile machines.

[5] Advantageous Effects

Finally, the following summarizes the advantageous effects of the present invention.

One aspect of the present invention is an image forming apparatus for fusing toner by using a fixing roller heated by electromagnetic induction caused by a magnetizing coil, and fixing a toner image on a recording sheet, the image forming apparatus comprising: a power source applying alternating current voltage to the magnetizing coil; a demagnetizing coil switchable between a conductive state and a cutoff state, and when in the conductive state, cancelling out a portion of a magnetic flux produced by the magnetizing coil; a contact switch and a semiconductor switch electrically connected in parallel, and, in combination, bringing the demagnetizing coil into the conductive state or the cutoff state; and a control unit opening or closing each of the contact switch and the semiconductor switch, wherein the control unit opens or closes the semiconductor switch in synchronization with a zero-crossing of the alternating current voltage at least when the contact switch is open, opens or closes the contact switch only when the semiconductor switch is closed, and opens the semiconductor switch when the demagnetizing coil brought into the conductive state by the contact switch needs to be maintained in the conductive state.

With the stated structure, when the contact switch is open, the control unit opens or closes the semiconductor switch in synchronization with a zero-crossing of the alternating current voltage. Therefore, the stated structure prevents the semiconductor switch from being applied with a high voltage, and from being deteriorated or damaged. Also, since the contact switch is opened or closed only when the semiconductor switch is in the closed state. Therefore, the stated structure prevents the contact switch from being deteriorated or fused by application of a high voltage. Furthermore, the control unit opens the semiconductor switch when the demagnetizing coil brought into the conductive state by the contact switch needs to be maintained in the conductive state. Therefore, the stated structure prevents degradation of the demagnetizing effect due to the on-resistance of the semiconductor switch, and prevents the semiconductor switch from being deteriorated or damaged by heat.

Optionally, when bringing the demagnetizing coil into the conductive state from the cutoff state, the control unit may first close the semiconductor switch in synchronization with a zero-crossing of the alternating current voltage, next close the contact switch, and then open the semiconductor switch. Optionally, when bringing the demagnetizing coil into the cutoff state from the conductive state, the control unit may first close the semiconductor switch, next open the contact switch, and then open the semiconductor switch in synchronization with a zero-crossing of the alternating current voltage that occurs immediately after the contact switch has been opened.

Optionally, when bringing the demagnetizing coil into the conductive state from the cutoff state, the control unit may first close the semiconductor switch in synchronization with a zero-crossing of the alternating current voltage and then close the contact switch, and when subsequently bringing the demagnetizing coil into the cutoff state from the conductive state, the control unit may first start opening the contact switch before a zero-crossing of the alternating current voltage that occurs immediately after the contact switch has been closed, and then open the semiconductor switch in synchronization with a zero-crossing of the alternating current voltage that occurs immediately after the contact switch has been opened. The stated structure reduces the duration of the conductive state of the demagnetizing coil, and therefore prevents the degradation of the efficiency that would be caused by repeatedly switching the demagnetizing coil between the conductive state and the cutoff state so as to prevent overheating of the non-sheet passing region.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

The invention claimed is:

1. An image forming apparatus for fusing toner by using a fixing roller heated by electromagnetic induction caused by a magnetizing coil, and fixing a toner image on a recording sheet, the image forming apparatus comprising:

a power source applying alternating current voltage to the magnetizing coil;

a demagnetizing coil switchable between a conductive state and a cutoff state, and when in the conductive state, cancelling out a portion of a magnetic flux produced by the magnetizing coil;

a contact switch and a semiconductor switch electrically connected in parallel, and, in combination, bringing the demagnetizing coil into the conductive state or the cutoff state; and a control unit opening or closing each of the contact switch and the semiconductor switch, wherein the control unit opens or closes the semiconductor switch in synchronization with a zero-crossing of the alternating current voltage at least when the contact switch is open, opens or closes the contact switch only when the semiconductor switch is closed, and opens the semiconductor switch when the demagnetizing coil brought into the conductive state by the contact switch needs to be maintained in the conductive state.

2. The image forming apparatus of claim 1, wherein when bringing the demagnetizing coil into the conductive state from the cutoff state, the control unit first closes the semiconductor switch in synchronization with a zero-crossing of the alternating current voltage, next closes the contact switch, and then opens the semiconductor switch.

3. The image forming apparatus of claim 1, wherein when bringing the demagnetizing coil into the cutoff state from the conductive state, the control unit first closes the semiconductor switch, next opens the contact switch, and then opens the semiconductor switch in synchronization with a zero-crossing of the alternating current voltage that occurs immediately after the contact switch has been opened.

4. The image forming apparatus of claim 1, wherein when bringing the demagnetizing coil into the conductive state from the cutoff state, the control unit first closes the semiconductor switch in synchronization with a zero-crossing of the alternating current voltage and then closes the contact switch, and when subsequently bringing the demagnetizing coil into the cutoff state from the conductive state, the control unit first starts opening the contact switch before a zero-crossing of the alternating current voltage that occurs immediately after the contact switch has been closed, and then opens the semiconductor switch in synchronization with a zero-crossing of the alternating current voltage that occurs immediately after the contact switch has been opened.

5. A control method for controlling a contact switch and a semiconductor switch of an image forming apparatus to bring a demagnetizing coil of the image forming apparatus into a conductive state or a cutoff state, the image forming apparatus being for fusing toner by using a fixing roller heated by electromagnetic induction caused by a magnetizing coil, and fixing a toner image on a recording sheet, the image forming apparatus comprising:

a power source applying alternating current voltage to the magnetizing coil;

the demagnetizing coil switchable between the conductive state and the cutoff state, and when in the conductive state, cancelling out a portion of a magnetic flux produced by the magnetizing coil; and the contact switch and the semiconductor switch electrically connected in parallel and, in combination, bringing the demagnetizing coil into the conductive state or the cutoff state, and the control method comprising:

when bringing the demagnetizing coil into the conductive state from the cutoff state, first, closing the semiconductor switch in synchronization with a zero-crossing of the alternating current voltage;

next, closing the contact switch only when the semiconductor switch is closed; and then opening the semiconductor switch.

6. The control method of claim 5, further comprising:

when bringing the demagnetizing coil into the cutoff state from the conductive state after the opening of the semiconductor switch, first, closing the semiconductor switch;

next, opening the contact switch; and then opening the semiconductor switch in synchronization with a zero-crossing of the alternating current voltage that occurs immediately after the contact switch has been opened.

7. A control method for controlling a contact switch and a semiconductor switch of an image forming apparatus to bring a demagnetizing coil of the image forming apparatus into a conductive state or a cutoff state, the image forming apparatus being for fusing toner by using a fixing roller heated by electromagnetic induction caused by a magnetizing coil, and fixing a toner image on a recording sheet, the image forming apparatus comprising:

a power source applying alternating current voltage to the magnetizing coil;

the demagnetizing coil switchable between the conductive state and the cutoff state, and when in the conductive state, cancelling out a portion of a magnetic flux produced by the magnetizing coil; and the contact switch and the semiconductor switch electrically connected in parallel and, in combination, bringing the demagnetizing coil into the conductive state or the cutoff state, and the control method comprising:

when bringing the demagnetizing coil into the cutoff state from the conductive state, first, closing the semiconductor switch in synchronization with a zero-crossing of the alternating current voltage;

next, opening the contact switch only when the semiconductor switch is closed; and then opening the semiconductor switch in synchronization with a zero-crossing of the alternating current voltage that occurs immediately after the contact switch has been opened.

* * * * *